US011535940B2

(12) United States Patent
Moeller et al.

(10) Patent No.: US 11,535,940 B2
(45) Date of Patent: Dec. 27, 2022

(54) USE OF AN ADHESION PROMOTER OBTAINABLE AS A REACTION PRODUCT OF A DI- OR POLY AMINE WITH α,β-UNSATURATED CARBOXYLIC ACID DERIVATIVES FOR METAL SURFACE TREATMENT

(71) Applicant: Henkel AG & Co. KGaA, Duesseldorf (DE)

(72) Inventors: Thomas Moeller, Duesseldorf (DE); Kristof Wapner, Duesseldorf (DE); Juergen Stodt, Neuss (DE); Natascha Henze, Leverkusen (DE); Kevin D. Murnaghan, Duesseldorf (DE); Ralf Posner, Dormagen (DE); Jan-Willem Brouwer, Willich (DE); Thomas S. Smith, II, Novi, MI (US); Donald R. Vonk, Clinton Township, MI (US)

(73) Assignee: Henkel AG & Co. KGaA, Duesseldorf (DE)

( * ) Notice: Subject to any disclaimer, the term of this patent is extended or adjusted under 35 U.S.C. 154(b) by 724 days.

(21) Appl. No.: 16/275,677

(22) Filed: Feb. 14, 2019

(65) Prior Publication Data

US 2019/0177853 A1 Jun. 13, 2019

Related U.S. Application Data

(63) Continuation of application No. PCT/EP2017/070018, filed on Aug. 8, 2017.

(60) Provisional application No. 62/378,465, filed on Aug. 23, 2016.

(51) Int. Cl.
*C23C 22/34* (2006.01)

(52) U.S. Cl.
CPC ..... *C23C 22/34* (2013.01)

(58) Field of Classification Search
None
See application file for complete search history.

(56) References Cited

U.S. PATENT DOCUMENTS

| | | | | |
|---|---|---|---|---|
| 3,305,493 | A | 2/1967 | Emmons | |
| 4,315,087 | A | 2/1982 | Redmore et al. | |
| 4,402,748 | A * | 9/1983 | Killat | C08G 69/48 106/31.28 |
| 6,812,298 | B2 | 11/2004 | Dvornic et al. | |
| 2004/0020565 | A1 * | 2/2004 | Melzer | C09D 179/02 148/247 |

FOREIGN PATENT DOCUMENTS

| | | | |
|---|---|---|---|
| CN | 1950543 | A | 4/2007 |
| CN | 102127767 | A | 7/2011 |
| DE | 10010758 | A1 | 9/2001 |
| DE | 10164671 | A1 | 7/2003 |
| DE | 102008053517 | A1 | 4/2010 |
| DE | 1020008053517 | A1 | 4/2010 |
| EP | 1433877 | A1 | 6/2004 |
| EP | 1455002 | A1 | 9/2004 |
| EP | 1433878 | B1 | 10/2008 |
| JP | 2015506274 | A | 3/2015 |

OTHER PUBLICATIONS

Verdier et al. "Monochromatized x-ray photoelectron spectroscopy of the AM60 magnesium alloy surface after treatments in fluoride-based Ti and Zr solutions". Surf. Interface Anal. 2005; 37: 509-516. (Year: 2005).*

Polymer Properties Database. "Hyperbranched Molecules: Part II: Synthesis of Dendrimers", <<http://polymerdatabase.com/polymer%20chemistry/Dendrimers2.html>> (last viewed Sep. 16, 2021) is cited as evidence both of Michael addition and of PAMAM structure). (Year: 2021).*

International Search Report for PCT/EP2017/070018, dated Nov. 2, 2017. All references cited in the International Search Report are listed herein.

S. Carlton Dickerman, et al, "Addition of Ethylenediamine to Methyl Methacrylate and to Acrylonitrile. Reaction of the Adducts.", Mar. 31, 1957, XP055417879, Retrieved from the Internet: URL: http://pubs.acs.org/doi/pdf/10.1021/jo01354a008.

Catherine M. B. Santini, et al, "Synthesis and bulk assembly behavior of linear-dendritic rod diblock copolymers", Journal of Polymer Science, Part A: Polymer Chemistry, vol. 42, No. 11, Apr. 30, 2004, pp. 2784-2814, XP055418287, ISSN: 0887-624X, DOI: 10.1002/pola.20156, pp. 2784-2792, figures 2,3.

Elisabeih Rossegger, et al, "Design Strategies for Functionalized Poly(2-oxazoline)s and Derived Materials", Polymers, Molecular Diversity Preservation International (M DP I) AG, CH; The Institution of Electrical Engineers, Stevenage, GB, vol. 5, No. 3, Jul. 15, 2013, pp. 956-1011, XP002738496, ISSN: 2073-4360, DOI: 10.3390/polym5030956 Scheme 16; pp. 993-994.

(Continued)

*Primary Examiner* — Alexander M Weddle
(74) *Attorney, Agent, or Firm* — Mary K. Cameron

(57) ABSTRACT

The invention relates to use of an adhesion promoting organic compound comprising at least one tertiary amine group, bonded via a bridge-constituting divalent radical, with the carbonyl carbon atom of an amide group, wherein the bridge-constituting divalent radical comprises two carbon atoms as bridge atoms, for anticorrosion pretreatment of metallic materials before painting and to aqueous compositions containing the adhesion promoting organic compound which generate conversion layers based on the elements Zr, Ti and/or Si. The present invention further comprises a process for anticorrosion coating of components at least partly manufactured from metallic materials comprising a pretreatment using acidic aqueous compositions according to the invention and subsequent painting. In a further aspect, the invention relates to a metallic substrate having a mixed organic/inorganic coating consisting of oxides, hydroxides and/or oxyfluorides of the elements Zr, Ti and/or Si and of the adhesion promoting organic compounds.

21 Claims, No Drawings

(56) References Cited

OTHER PUBLICATIONS

Perignon et al, "Hyperbranched Polymers Analogous to PAMAM Dendrimers for the Formation and Stabilization of Gold Nanoparticles", Marcomolecules, vol. 40, No. 9, 2007, 3034-3041.
Anders Hult, et al, "Hyperbranched Polymers", Advances in Polymer Science, vol. 143, Springer-Verlag Berlin Heidelberg (1999).

* cited by examiner

USE OF AN ADHESION PROMOTER OBTAINABLE AS A REACTION PRODUCT OF A DI- OR POLY AMINE WITH α,β-UNSATURATED CARBOXYLIC ACID DERIVATIVES FOR METAL SURFACE TREATMENT

The present invention relates to the use of an adhesion-promoting organic compound having at least one tertiary amine group which, in turn, is linked via a bridge-forming divalent functional group to the carbonyl carbon atom of an amide group, the bridge-forming divalent functional group having two carbon atoms as bridge atoms, for the anti-corrosion pretreatment of metal materials before painting. The invention covers aqueous compositions which produce conversion coatings based on the elements Zr, Ti and/or Si. Furthermore, the present invention comprises a method for the anti-corrosion coating of components made at least in part of metal materials, comprising a pretreatment using acidic aqueous compositions according to the invention and subsequent painting. In another aspect, the invention relates to a metal substrate comprising a mixed organic/inorganic coating consisting of oxides, hydroxides and/or oxyfluorides of the elements Zr, Ti and/or Si, and the adhesion-promoting organic compounds.

The conversion treatment of metal surfaces in order to provide an anti-corrosion coating based on aqueous compositions containing water-soluble compounds of the elements Zr, Ti and/or Si is a technical field that has been extensively described in the patent literature. For improving the profile of properties of conversion treatments of this kind in terms of protection from corrosion and promotion of adequate paint adhesion, a wide range of variants of a metal pretreatment of this kind are known which aim either to convert the metal surfaces by adding a pickling agent or to condition the metal surface in a series of steps. In particular, organic compounds are often added or applied in a method step following the conversion treatment which are intended to assume the function of an adhesion promoter and have certain chemical functionalities for this purpose which promise a chemical interaction with the organic components of the paint coating.

In this regard, EP 1 433 877 A1 teaches the addition of additives to a chromium-free, acidic, aqueous composition based on the elements Zr, Ti and/or Hf for the purpose of forming a conversion coating with aminosilanes, while EP 1 433 878 B1 suggests the addition of isocyanate-modified epoxide compounds, and EP 1 455 002 A1, in turn, emphasizes in one aspect the positive effect of polymers based on vinyl amines and allyl amines for the anti-corrosion effect.

DE 10005 113 A1 provides a very general description of the positive effect of homopolymers and/or copolymers of vinylpyrrolidone, in particular of copolymers of vinyl pyrrolidone with additional caprolactam groups, in the treatment of uncoated metal surfaces for subsequent painting.

In view of this prior art, the problem addressed was to further homogenize the anti-corrosion properties of conversion coatings on various metal substrates obtainable by pretreatment with compositions of water-soluble compounds of the elements Zr, Ti and/or Si, and in particular to improve the anti-corrosion properties on steel surfaces. In particular, the average disbonding values in the corrosive delamination after paint coat build-up are intended to be improved. Moreover, a slight variance in the conversion coating is intended to be achieved under identical process conditions, i.e. it is intended that a reproducible conversion of the metal surface can be achieved technically. Furthermore, a greater tolerance to increased treatment times, such as those which occur regularly despite automation, for example, due to the occasional system downtime of a pretreatment line for maintenance or production-related purposes, is desirable. In conventional pretreatment baths which bring about conversion of the metal surfaces based on the elements Zr, Ti and/or Si, the anti-corrosion properties diminish in the case of extended exposure in the pretreatment bath despite increased coating thickness. With regard to use on different metal substrates, what is desired in particular is an optimum anti-corrosion effect of composite structures which have, in addition to surfaces of iron and/or steel, surfaces of at least one of the materials zinc, galvanized steel and/or aluminum by means of a corresponding wet-chemical pretreatment.

This problem is solved in a first aspect of the present invention by an acidic aqueous composition for the anti-corrosion pretreatment of metal surfaces containing (A) at least one water-soluble compound of the elements Zr, Ti and/or Si;

(B) at least one source of fluoride ions; and (C) at least one adhesion promoter which is an organic compound having at least one tertiary amine group that is linked via a bridge-forming divalent functional group to the carbonyl carbon atom of an amide group, the bridge-forming divalent functional group having two carbon atoms as bridge atoms.

A compound of the elements Zr, Ti and/or Si according to component (A) is water-soluble if its solubility in deionized water ($\kappa<1\ \mu Scm^{-1}$) at 20° C. is at least 0.001 wt. %.

Unless another unit of reference is expressly indicated, all of the relative weight proportions cited below in "g/kg" refer to the acidic aqueous composition according to the invention.

In the first aspect of the present invention, a quantity of active components sufficient for forming a conversion coating is certainly contained in the acidic aqueous composition if at least one of the elements Zr, Ti or Si is contained in the form of compounds according to component (A) having at least 0.005 g/kg calculated as Zr, and therefore this minimum proportion is preferred. In this context, a total proportion of compounds according to component (A) of at least 0.01 g/kg, preferably of at least 0.03 g/kg, particularly preferably of at least 0.05 g/kg calculated as Zr is also preferred.

Due to economic considerations, it is also advantageous if the total proportion of compounds according to component (A) with respect to the elements Zr, Ti and Si is preferably no more than 1 g/kg, particularly preferably no more than 0.5 g/kg, more particularly preferably no more than 0.3 g/kg, since greater contents usually do not further improve the anti-corrosion properties of the conversion coating but rather, due to the greater deposition kinetics, render it more difficult to control the coating thickness with respect to these elements.

Suitable representatives of the water-soluble compounds of the elements Zr, Ti or Si according to component (A) are compounds that dissociate in aqueous solutions into anions of fluoro complexes. Preferred compounds of this kind are, for example, $H_2ZrF_6$, $K_2ZrF_6$, $Na_2ZrF_6$ and $(NH_4)_2ZrF_6$ and the analogous titanium and silicon compounds. Fluorine-free compounds of the elements Zr, Ti or Si, in particular of the elements Zr or Ti, can also be used according to the invention as water-soluble compounds, for example $(NH_4)_2Zr(OH)_2(CO_3)_2$ or $TiO(SO_4)$ or silanes having at least one covalent Si—O bond.

Moreover, an acidic composition according to the invention contains a source of fluoride ions, which is necessary for a homogeneous and reproducible conversion of the metal surfaces into an anti-corrosion coating. Any inorganic compound that can release fluoride ions when dissolved or dispersed in water is suitable as a source of fluoride ions. Complex or simple fluorides constitute one preferred source of fluoride ions. A person skilled in the art understands simple fluorides as being hydrofluoric acid and salts thereof such as alkali fluorides, ammonium fluoride or ammonium bifluoride, while, according to the invention, complex fluorides are coordination compounds in which fluorides are present in a coordinated manner as ligands of one or more central atoms. Accordingly, preferred representatives of the complex fluorides are the aforementioned fluorine-containing complex compounds of the elements Zr, Ti or Si.

The proportion of components (B), which are a source of fluoride ions, in the acidic aqueous composition is preferably at least large enough that the acidic aqueous composition contains a quantity of free fluoride of at least 0.005 g/kg, preferably of at least 0.01 g/kg, but preferably no more than 0.4 g/kg, particularly preferably no more than 0.1 g/kg. The free fluoride content is determined at 20° C. by means of a calibrated fluoride-sensitive electrode directly in the acidic aqueous composition.

Moreover, for optimum conversion of a metal surface, in particular one made of iron, by means of contact with an acidic aqueous composition according to the invention, it is preferable for component (B) to be contained in such a quantity that the molar ratio of the total fluoride content to the total quantity of components (A) with respect to the elements Zr, Ti and Si is more than 4.5, preferably more than 5.0, particularly preferably more than 5.5. The total fluoride proportion is determined at 20° C. using a fluoride-sensitive electrode in a TISAB-buffered aliquot portion of the acidic aqueous composition (TISAB: "Total Ionic Strength Adjustment Buffer"), with the mixture ratio by volume of buffer to the aliquot portion of the acidic aqueous composition being 1:1. The TISAB buffer is prepared by dissolving 58 g NaCl, 1 g sodium citrate and 50 ml glacial acetic acid in 500 ml deionized water ($\kappa<1\ \mu Scm^{-1}$), setting a pH of 5.3 using 5 N NaOH and filling to a total volume of 1000 ml, again with deionized water ($\kappa<1\ \mu Scm^{-1}$).

In a preferred embodiment, in order to accelerate the conversion of the metal surfaces that are brought into contact with the composition, the acidic aqueous composition additionally contains at least one water-soluble compound (D) which is a source of copper ions, preferably in the form of a water-soluble salt, for example copper sulfate, copper nitrate and copper acetate. The presence of copper ions is also advantageous for the anti-corrosion properties of the conversion coating formed on the surfaces of the metal materials during the conversion. The content of copper ions from water-soluble compounds (D) in the acidic aqueous composition is preferably at least 0.001 g/kg for this purpose, particularly preferably at least 0.005 g/kg. However, the content of copper ions is preferably not above 0.1 g/kg, particularly preferably not above 0.05 g/kg, since the deposition of elemental copper otherwise begins to dominate in relation to the formation of the conversion coating.

Moreover, for a fast and reproducible conversion of the metal surfaces, it is preferable according to the invention for the acidic aqueous composition to additionally contain at least one water-soluble compound (E) which has a standard reduction potential at pH 0 of above +0.6 V (SHE) and is preferably selected from inorganic nitrogen compounds, particularly preferably from nitric acid and/or nitrous acid and salts thereof. In order to accelerate the formation of the conversion coating, the proportion of water-soluble compounds (E) is preferably at least 0.001 mol/L, more preferably at least 0.01 mol/L, but, for economic reasons, preferably less than 0.2 mol/L.

Furthermore, the method is characterized by its high level of tolerance for zinc ions, which inevitably accumulate in the pretreatment bath during the treatment of galvanized steel. It has also been found that the presence of zinc ions has an advantageous effect on the build-up of the conversion coating, and therefore compositions according to the invention preferably additionally contain zinc ions, as component (F), preferably at least 0.1 g/kg of zinc ions, particularly preferably at least 0.3 g/kg of zinc ions, but preferably no more than 3 g/kg of zinc ions.

The pH of the acidic aqueous composition according to the invention is preferably above 3.0, particularly preferably above 3.5, more particularly preferably above 4.0, but preferably below 5.5, particularly preferably below 5.0.

As for the at least one adhesion promoter according to component (C) contained in the composition according to the invention, the bridge-forming divalent functional group covalently links a tertiary amine group to the carbonyl carbon atom of an amide group, the bridge-forming divalent functional group being formed of two carbon atoms acting as bridge atoms. In relation to compounds according to component (C), a bridge atom is always an atom that is a component of the shortest chain of covalently bonded atoms that links the tertiary amine group to the carbonyl carbon atom of the amide group. The substitution of the bridge atoms is not limited to certain functional groups; however, the bridge atoms are preferably substituted, independently of one another, with functional groups selected from hydrogen, branched or unbranched aliphatic compounds having no more than 6 carbon atoms, alkylcarboxylic acids having no more than 5 carbon atoms, or with divalent aliphatic functional groups having at least 3, but no more than 5, carbon atoms that interlink the two bridge atoms.

Besides improving the disbonding values, the presence of the adhesion promoters according to component (C) of the compositions according to the invention brings about in particular further homogenization of the formation of the conversion coating on different metal materials, with the effect that the anti-corrosion performance remains stable over a broad duration of application and defects in the growing conversion coating as a result of local corrosive disintegration thereof in the pickling medium can be controlled to a large extent. This characteristic of being less prone to "over-pickling" and thus having a greater tolerance in terms of duration of application is attractive in terms of the process, since system downtime in the pretreatment line does not result in the need to remove the car bodies that were exposed to a substantially longer treatment time. Moreover, the above-described characteristic of the compositions according to the invention of not over-pickling also has significance for the opening of a suitable time window in the pretreatment of components made of different materials in a composite structure, since different materials usually have different minimum treatment times for establishing an optimum coating weight. With the aid of the present compositions, the minimum treatment time of each current metal material can now be achieved without "over-pickling" another metal material and damaging the conversion coating thereon.

In a preferred embodiment of the composition according to the invention, the adhesion promoter according to component (C) additionally contains at least one secondary amine group which is linked via at least one bridge-forming divalent functional group to the carbonyl carbon atom of an amide group, the bridge-forming divalent functional group having two carbon atoms as bridge atoms which, in turn, can be substituted in any manner; however, the bridge atoms are preferably substituted independently of one another with functional groups selected from hydrogen, branched or unbranched aliphatic compounds having no more than 6 carbon atoms, alkylcarboxylic acids having no more than 5 carbon atoms or with divalent aliphatic functional groups having at least 3, but no more than 5, carbon atoms that interlink the two bridge atoms.

Finally, it is advantageous for the promotion of the adhesion to subsequently applied paints if the adhesion promoter according to component (C) in the composition according to the invention additionally comprises at least one primary amine group.

Overall, it has been found to be especially advantageous, in particular for preventing corrosive disbonding after paint coat build-up on ferrous materials such as steel, if the molar ratio of the total number of primary and secondary amine groups to the number of tertiary amine groups with respect to the total of the adhesion promoters according to component (C) is less than 5, preferably less than 4, but preferably more than 0.75, particularly preferably more than 1. Corresponding compositions are preferred according to the invention, with the aforementioned condition preferably being met for those compositions according to the invention for which at least one adhesion promoter according to component (C) is contained that contains at least one primary amine group and at least one secondary amine group, in which the secondary amine group is linked via at least one bridge-forming divalent functional group to the carbonyl carbon atom of an amide group, the bridge-forming divalent functional group having two carbon atoms as bridge atoms, and particularly for those compositions according to the invention for which the proportion of the previously described adhesion promoter with respect to component (C) is at least 20 wt. %, preferably at least 50 wt. %.

According to the invention, the molar ratio of the total number of primary and secondary amine groups to the total number of tertiary amine groups can be obtained experimentally from the difference between the total base number determined in potentiometric titration by means of trifluoromethanesulfonic acid in glacial acetic acid according to standard method H-III 20a (98) of the German Society for Fat Science (Deutsche Gesellschaft für Fettwissenschaft e.V. (DGF)), and the tertiary amine number measured using the acetic anhydride method according to DGF standard method H-III 20b (98), then divided by the aforementioned tertiary amine number, with all numerical values referring to nitrogen in g per 100 g of the same sample. The sample of the adhesion promoter (C) according to the present invention is ideally the substance or a concentrated dosage form of the adhesion promoter, but it should not be a water-based dosage form, or can be taken directly from the reaction mixture for the preparation thereof.

Furthermore, it is apparent that, according to the invention, compositions are preferred in which the molecular weight of the adhesion promoter according to component (C) is above 200 g/mol, preferably above 400 g/mol, particularly preferably above 500 g/mol. The characteristic of the adhesion promoters imparted in this way of being immobilized in sufficient quantity on the conversion-treated metal surface can also be promoted if the total of all of the adhesion promoters according to component (C) contained in the acidic aqueous composition has a weight-average molar mass above 500 g/mol, preferably above 1,000 g/mol. This total is therefore preferred according to the invention.

The weight-average molar mass is determined using the molar mass distribution curve of a sample of the adhesion promoter (C) according to the present invention established experimentally at 30° C. by means of size-exclusion chromatography using a concentration-dependent refractive index detector and calibrated against polyethylene glycol standards. The sample is ideally the substance or a concentrated dosage form of the adhesion promoter, for example an aqueous concentrate thereof, or can be removed directly from the reaction mixture for preparing the adhesion promoter (C). The average molar masses are analyzed using the strip method with a third-order calibration curve. Hydroxylated polymethacrylate is suitable as a column material, and an aqueous solution of 0.2 mol/L sodium chloride, 0.02 mol/L sodium hydroxide, 6.5 mmol/L ammonium hydroxide is suitable as an eluent.

The adhesion promoter according to component (C) that can be used in the acidic aqueous composition can be derived from the reaction of a di- or polyamine with an α,β-unsaturated carboxylic acid and the ester and amide thereof. The spontaneous and exothermic reaction goes through at least one aza-Michael addition of the di- or polyamine to the α,β-unsaturated carboxylic acid or the α,β-unsaturated carboxylic acid ester or the α,β-unsaturated carboxylic acid amide. Higher-molecular adhesion promoters according to component (C) are formed after the amidation of the carboxylic acid, of the ester or of the amide with other di- or polyamines via subsequent aza-Michael additions.

Accordingly, the adhesion promoter according to component (C) of the composition according to the invention can preferably be obtained by means of a one-pot reaction of a quantity of one or more di- and/or polyamines, preferably one or more alkylene diamines having no more than 12 carbon atoms, particularly preferably no more than 6 carbon atoms, and/or one or more polyalkyleneamines having no more than 12 carbon atoms, particularly preferably no more than 6 carbon atoms, between neighboring amine groups, with a quantity of one or more α,β-unsaturated carboxylic acids and esters and amides thereof, preferably (meth) acrylic acid alkyl ester, particularly preferably (meth)acrylic acid methyl ester and/or (meth)acrylic acid ethyl ester, more particularly preferably the respective acrylic acid alkyl esters.

Preferred diamines for the one-pot reaction described above are 1,2-xylylenediamine, 1,3-xylylenediamine, 1,4-xylylenediamine, 1,2-diaminocyclohexane, 1,3-diaminocyclohexane, 1,4-diaminocyclohexane, ethylenediamine, 1,3-diaminopropane, 1,2-diaminopropane, 1,4-diaminobutane, 1,3-diaminobutane, 1,2-diaminobutane, 1,5-diaminopentane, 1,4-diaminopentane, 1,3-diaminopentane, 1,2-diaminopentane, 1,6-diaminohexane, 1,5-diaminohexane, 1,4-diaminohexane, 1,3-diaminohexane, 1,2-diaminohexane, isophorone diamine, tetracyclodecane diamine, including the secondary amines thereof, which, each independently of one another, are alkyl-substituted with no more than 6 carbon atoms, and piperazine.

Other diamines according to the invention are amine-terminated polyethylene and polypropylene oxides, and amine-terminated copolymers of ethylene oxide and propylene oxide, each of which is commercially available in the product series Jeffamine® D, Jeffamine® ED, Jeffamine® DER and Jeffamine® THF from Huntsmen.

Preferred polyamines for the above-described one-pot reaction are spermidine, spermine, dipropylene triamine, diethylene triamine, tripropylene tetramine, triethylene tetramine, tetraethylene pentamine, hexaethylene heptamine, 1-(2-aminoethyl)piperazine, 1-aminoethylpiperazyl diethylene triamine, 1-aminoethylpiperazyl triethylene tetramine, aminoethyl propylene diamine, 1,4-bis(2-aminoethyl)piperazine, 1,4-bis(3-aminopropyl)piperazine and the polyethylene and polypropylene imines, including the aforementioned polyamines, in which at least one terminal amino group is alkyl-monosubstituted with no more than 6 carbon atoms.

Other polyamines according to the invention are amine-terminated polyethylene and polypropylene oxides, as well as amine-terminated copolymers of ethylene oxide and propylene oxide, each of which is commercially available in the product series Jeffamine® T and Jeffamine® THF from Huntsmen.

The reaction mixture resulting from a one-pot reaction of this kind can be added directly to an acidic aqueous composition containing components (A) and (B) in order to prepare a composition according to the invention. The one-pot reaction is preferably carried out "in substance," so that the proportion of components other than di- and polyamines, α,β-unsaturated carboxylic acids, and esters and amides thereof is preferably below 10 wt. %, particularly preferably below 1 wt. %. Moreover, in order to provide particularly effective adhesion promoters according to component (C) of the composition according to the invention, it is preferable for the quantity of di- and/or polyamines to be first provided and the quantity of α,β-unsaturated carboxylic acids, α,β-unsaturated carboxylic acid esters and/or α,β-unsaturated carboxylic acid amides to be added gradually, while the reaction temperature preferably does not exceed 120° C., particularly preferably 100° C., more particularly preferably 80° C.

After the gradual addition of the reactant, a subsequent condensation phase is advantageous for the further polymer build-up of the reaction products, in which the reaction mixture is subjected for a predetermined duration to an initially elevated temperature in the dense system, for example under reflux, immediately after which volatile condensation products are removed at least in part from the reaction mixture by means of distillation, insofar as α,β-unsaturated carboxylic acid esters are added gradually as a reactant, preferably in such a quantity that corresponds to at least 80% of the ester alcohols available in the reaction mixture. The distillation can be followed, in turn, by a high-temperature phase in the dense system, upon the conclusion of which the condensation phase is completed.

The gradual addition of the reactant to the quantity of the already provided di- and/or polyamine in order to prepare an adhesion promoter (C) is therefore preferably followed by a condensation phase in which a temperature above the previously prevailing reaction temperature is set that is however not above 200° C., particularly preferably not above 180° C. The distillation can preferably also be performed under reduced pressure.

The converse method for providing the adhesion promoter according to component (C), in which the quantity of α,β-unsaturated carboxylic acids, α,β-unsaturated carboxylic acid esters and/or α,β-unsaturated carboxylic acid amides is first provided and the quantity of di- and/or polyamines is gradually added, is possible. However, it is preferable for the formulation of compositions according to the invention for the quantity of di- and/or polyamines to be provided first.

As already pointed out, it is advantageous for preventing the corrosive disbonding of coats of paint on ferrous materials such as steel if a certain ratio of primary and secondary amines to tertiary amines is set in the adhesion promoter according to component (C) of a composition according to the invention. Such a ratio can also be set via the molar ratio of the reactants of the one-pot reaction.

In this respect, the adhesion promoters according to component (C) for providing a composition according to the invention with the quantity of di- and/or polyamines being provided first can preferably be obtained such that, for the quantities of the reactants brought together in the one-pot reaction, the molar ratio of the di- and/or polyamines to α,β-unsaturated carboxylic acids and esters and amides thereof is no more than 2, preferably no more than 1.5, particularly preferably no more than 1.2, more particularly preferably no more than 1.0, but preferably no less than 0.5, particularly preferably no less than 0.6, more particularly preferably no less than 0.7.

The composition according to the invention preferably contains at least 0.005 g/kg, particularly preferably at least 0.01 g/kg, more particularly preferably at least 0.05 g/kg, but preferably less than 5 g/kg, particularly preferably less than 1 g/kg, more particularly preferably less than 0.5 g/kg, of organic compounds that are adhesion promoters according to component (C).

While the preferred minimum quantity of 0.005 g/kg of component (C) represents a lower limit below which the reproducibility of the positive effect on the prevention of the corrosive delamination of subsequently applied coats of paint decreases significantly, an upper limit is established substantially for economic reasons, since the properties are not improved above these values and the application of the acidic aqueous composition results in the formation of a primer coating at best, and therefore a conversion of the metal surfaces is achieved only with a small coating thickness (<1 μm).

Of greater importance than the absolute quantity of component (C) is its relative proportion with respect to the quantity contained of components (A), since that also helps determine the balance between the organic and inorganic portions of the conversion coating. It has been found to be advantageous in this connection for preventing the corrosive delamination of subsequently applied coats of paint and the formation of homogeneous conversion coatings if the weight ratio of component (A) calculated as Zr to component (C) is no less than 0.2, preferably no less than 0.5, but preferably no more than 10, particularly preferably no more than 5. Corresponding acidic aqueous compositions are therefore preferred according to the invention.

The acidic aqueous composition according to the invention can contain other organic compounds, in particular polymers and copolymers, that are known to a person skilled in the field of surface treatment for improving the properties of the conversion coating. Compounds of this kind can be, for example, water-soluble or water-dispersible acrylates, epoxides, urethanes or copolymers of olefins and α,β-unsaturated carboxylic acids or esters thereof, and copolymers of vinylphosphonic acid with unsaturated monomers, polyvinyl alcohols or polyalkylene imines.

In a preferred embodiment, the proportion of organic compounds that are not adhesion promoters according to component (C) but have a weight-average molar mass above 500 g/mol is less than 1 g/kg, preferably less than 0.2 g/kg, particularly preferably less than 0.1 g/kg, more particularly preferably less than 0.01 g/kg. This ensures that the positive influence of the organic compounds (C) on the build-up of the conversion coating remains dominant and is not negated by interaction with other organic compounds.

In an embodiment of a passivating conversion coating on different interconnected metal materials that is particularly suitable and therefore preferred, the composition according to the invention contains (A) at least 0.005 g/kg, calculated as Zr, of water-soluble compounds of the elements Zr, Ti and/or Si;

(B) at least one source of fluoride ions;

(C) at least 0.005 g/kg, preferably at least 0.01 g/kg, particularly preferably at least 0.05 g/kg, but preferably less than 5 g/kg, particularly preferably less than 1 g/kg of adhesion promoters, each of which is an organic compound having at least one tertiary amine group which is connected via a bridge-forming divalent functional group to the carbonyl carbon atom of an amide group, the bridge-forming divalent functional group having two carbon atoms as bridge atoms, preferably obtainable by means of the one-pot reaction of a quantity of one or more di- and/or polyamines, preferably one or more alkylene diamines having no more than 12 carbon atoms and/or one or more polyalkylene amines having no more than 12 carbon atoms between neighboring amine groups with a quantity of one or more (meth)acrylic acid alkyl esters, preferably one or more (meth)acrylic acid methyl esters and/or (meth)acrylic acid ethyl esters; and (D) additionally, at least one water-soluble compound that is a source of copper ions, preferably in the form of a water-soluble salt;

(E) at least one water-soluble compound which has a standard reduction potential at pH 0 of above +0.6 V (SHE) and is preferably selected from inorganic nitrogen compounds, particularly preferably from nitric acid and/or nitrous acid and salts thereof; and (F) additionally, a quantity of zinc ions, preferably at least 0.1 g/kg of zinc ions; with the weight ratio of component (A) calculated as Zr to component (C) being no less than 0.2, preferably no less than 0.5, but preferably no more than 10, particularly preferably no more than 5, and with less than 1 g/kg, particularly preferably less than 0.1 g/kg, more particularly preferably less than 0.01 g/kg, of organic compounds which have a weight-average molar mass above 500 g/mol and are not adhesion promoters according to component (C) being contained.

In a second aspect, the present invention relates to a method for the anti-corrosion coating of components made at least in part of metal materials, in which i) at least some of the surfaces of the component that are made of the metal materials are brought into contact with an acidic aqueous composition according to the first aspect of the present invention;

and subsequently ii) at least some of the surfaces of the component that are made of the metal materials and were brought into contact with the acidic aqueous composition in step i) are painted.

The components that are treated using the method according to the invention are made at least in part of metal materials. Within the meaning of the second aspect of the present invention, more than 50 at. % of a metal material consists of one or more metal elements having a standard reduction potential of $Me^0 \rightarrow Me^{n+} + ne^-$ of no more than +0.2 V (SHE) and no less than −2.4 V (SHE). Metal elements of this kind are the constitutive elements of the material and are preferably selected from Fe, Zn, Al, Mg, Sn or Ni. The metal material can contain any other metal or non-metal elements.

The metal material can also be a metal-coated substrate, provided that the metal coating has a layer thickness of at least 1 μm and at least 50 at. % of said coating consists of the previously defined constitutive elements. Materials of this kind are all plated ferrous materials such as electrolytically or hot dip-galvanized steel, preferably plating in the form of zinc (Z), aluminum silicon (AS), zinc magnesium (ZM), zinc aluminum (ZA), aluminum zinc (AZ) or zinc iron (ZF).

The components treated according to the present invention can be spatial structures of any shape and design that originate from a fabrication process, in particular also including semifinished products such as belts, sheets, rods, pipes, etc., and composite structures assembled from said semifinished products, the semifinished products preferably being interconnected to form composite structures by means of adhesion, welding and/or crimping.

Preferred metal materials for which an improvement to the properties of the conversion coating as a paint base becomes clearly apparent are ferrous materials, in particular steel. On the surfaces of the ferrous materials, a significant improvement in the anti-corrosion effect occurs in the corrosive disbonding at paint defects.

A ferrous material is characterized in that its iron content is more than 50 at. %. Preferred ferrous materials are steel, with steel including metal materials of which the mass fraction of iron is greater than that of every other element, and of which the carbon content, without taking into account carbides, is less than 2.06 wt. %.

Accordingly, methods according to the second aspect are preferred according to the invention in which the component is either made of ferrous materials or, in a composite structure with other metal materials, has at least some surfaces of iron, preferably at least 5%, particularly preferably at least 10%, particularly preferably at least 20%, of the metal surfaces of the compositely structured component being iron, preferably steel.

Moreover, the method according to the second aspect of the present invention is particularly suitable for pretreating the surfaces of semifinished products made of different metal materials that are assembled in a composite structure such that at least two different metal materials are electrically interconnected, at least one of the electrically interconnected metal materials being a ferrous material.

In the method according to the invention, step ii) preferably comprises the application of an organic coating as a paint, specifically as a powder coating or dip paint which, in turn, is preferably an electrocoating, particularly preferably a cathodic electrocoating. In a particularly preferred embodiment, the cathodic electrocoating is based on an aqueous dispersion of an amine-modified film-forming polyepoxide which preferably additionally comprises, as accelerators, organic compounds containing blocked and/or unblocked isocyanate groups.

The electrocoating preferably follows a rinsing step, but particularly preferably does not follow a drying step.

According to the invention, a rinsing step is always used to remove, by means of a water-based liquid medium, water-soluble residues, not firmly adhering chemical compounds and loose solid particles from the component to be treated that were carried over from a preceding wet-chemical treatment step, together with the wet film adhering to the component. In this case, the water-based liquid medium does not contain any chemical components that bring about significant surface coverage of the components made of metal materials with subgroup elements, metalloid elements or polymeric organic compounds. Such significant surface coverage occurs in any case if the liquid rinsing medium were to deplete these components by at least 10 milligrams per square meter of the rinsed surfaces, preferably by at least 1 milligram per square meter of the rinsed surfaces, with respect to the particular element or the particular polymeric organic compound, without considering gains through carryover and losses through removal by wet films adhering to the component.

In the context of the present invention, a drying step is any method step in which drying of the aqueous liquid film adhering to the surface of the component is brought about intentionally and not merely coincidentally by providing and using technical means, in particular by supplying thermal energy or applying an airflow.

Moreover, in the event that the component has surfaces of a metal material of which the constitutive element is zinc, for example galvanized steel, it is generally preferable for a thin amorphous layer containing iron to be applied to those surfaces, thereby conferring to the surfaces of these materials just as effective a formation of a conversion coating in step i) of the method according to the invention as is usually observed for the surfaces of iron and/or steel. Ironizing of zinc and/or galvanized steel surfaces that is especially effective in this regard is described in published patent applications WO 2011098322 A1 and WO 2008135478 A1 as a wet-chemical method that can be applied in an equivalent manner immediately prior to carrying out method step i) according to the invention. In this respect, it is therefore preferable in methods according to the invention in which the component is made at least in part of zinc for the surfaces of the component made of these materials to contain an iron coating of at least 20 $mg/m^2$, but preferably no more than 150 $mg/m^2$.

In a third aspect, the present invention relates to a painted metal substrate having a mixed organic/inorganic intermediate layer consisting of oxides, hydroxides and/or oxyfluorides of the elements Zr, Ti and/or Si and organic compounds having at least one tertiary amine group that is linked via a bridge-forming divalent functional group to the carbonyl carbon atom of an amide group, the bridge-forming divalent functional group having two carbon atoms as bridge atoms. In the context of the third aspect of the present invention, an intermediate coating is present if the intermediate layer is implemented starting from the metal substrate and the paint is applied directly thereto.

In the context of the third aspect of the present invention, preferred embodiments of the organic compounds having at least one tertiary amine group that is linked via a bridge-forming divalent functional group to the carbonyl carbon atom of an amide group, the bridge-forming divalent functional group having two carbon atoms as bridge atoms, are identical to those organic compounds that are emphasized as being preferred adhesion promoters in the context of the first aspect of the present invention.

In a fourth aspect, the present invention relates to the use of an adhesion promoter selected from organic compounds having at least one tertiary amine group that is linked via a bridge-forming divalent functional group to the carbonyl carbon atom of an amide group, the bridge-forming divalent functional group having two carbon atoms as bridge atoms, the organic compounds having a weight-average molar mass above 500 g/mol, for the pretreatment of metal surfaces before painting.

Preferred structural embodiments of the organic compounds that are adhesion promoters in the context of the fourth aspect of the present invention are identical to those which are emphasized as being preferred with respect to the adhesion promoter in the context of the first aspect of the present invention.

PRACTICAL EXAMPLES

Sheets of different metal materials were cleaned, pretreated and electrocoated according to the following sequence.

A. Alkaline degreasing at pH 10.5:
   1 wt. % BONDERITE® C-AK 1561 (Henkel)
   in deionized water ($\kappa<1$ $\mu Scm^{-1}$);
   Application by spraying at 60° C. for 180 seconds at 1.5-2.0 bar
B. Step of rinsing with deionized water ($\kappa<1$ $\mu Scm^{-1}$) at 20° C.
C. Alkaline immersion cleaning at pH 11.5-11.7:
   4 wt. % BONDERITE® C-AK 2011 (Henkel)
   0.4 wt. % BONDERITE® C-AD 1580 (Henkel)
   in deionized water ($\kappa<1$ $\mu Scm^{-1}$);
   Application by dipping at 56° C. for 180 seconds
D. Step of rinsing with deionized water ($\kappa<1$ $\mu Scm^{-1}$) at 20° C.
E. Conversion treatment with acidic aqueous composition according to exemplary formulations E1-E7 in table 2:
   Application by dipping at 35° C.
F. Step of rinsing with deionized water ($\kappa<1$ $\mu Scm^{-1}$) at 20° C.
G. Cathodic electrocoating (CathoGuard 800, BASF Coatings):
   Layer thickness of 20-22 μm after drying in the stoving oven at 180° C. for 35 minutes Preparation of an Aqueous Concentrate of Adhesion Promoter C1:

210.34 parts by weight of 1,2-diaminoethane were first provided in a glass flask having a stirring system. 301.44 parts by weight of methyl acrylate were then added in a dropwise manner, with stirring, according to the intended molar ratio of 1:1 between the reactants. The internal temperature rose and was kept at 65 to 70° C. in the reaction mixture during the dropwise addition by applying external cooling and adjusting the drop rate.

After the addition of the quantity of methyl acrylate, the condensation phase was initiated by heating the reaction mixture to above 120° C. within half an hour at a constant heating rate, but only to the jacket temperature at which the formation of a condensate became clearly visible under the prevailing reflux conditions (initial temperature of condensation). After the initial temperature was reached, the jacket temperature was maintained for another 90 minutes under reflux conditions. During this time, the temperature of the reaction mixture dropped to approximately 90° C. The reflux conditions were then eliminated, and a switch was made to distillation mode. The jacket temperature was increased gradually for this purpose to 165° C. while the methanol was being removed, and was kept at this maximum temperature for 30 minutes. The entire condensation phase lasted for 285 minutes.

The reaction mixture was then cooled to 100° C., and a quantity of water ($\kappa<1$ $\mu Scm^{1}$) was added with vigorous stirring that was such that a 10 wt. % aqueous concentrate of the relevant adhesion promoter was obtained.

Table 1 shows the preparation conditions of the other adhesion promoters C2-C5 on the basis of which the cited concentrates C2-C5 were obtained, the application solutions were formulated according to examples E1-E7 (see table 2), and sheets of cold-rolled steel (CRS), hot-dip galvanized (HDG) steel and aluminum were pretreated and electrocoated according to the process sequence defined above. The results with respect to the anti-corrosion effect are shown in table 3.

TABLE 1

Preparation of aqueous concentrates containing adhesion promoters C1-C5

| | C1 | C2 | C3 | C4 | C5 |
|---|---|---|---|---|---|
| Acrylate[1] | MA | EA | EA | EA | EA |
| Molar ratio[2] | 1 | 1 | 0.5 | 0.75 | 1.5 |
| Duration[3]/minutes | 285 | 325 | 325 | 335 | 290 |

[1]methyl acrylate (MA); ethyl acrylate (EA): initial temperature 140° C.
[2]ethylene diamine:acrylate
[3]duration of the condensation phase

TABLE 2

| Application solutions for pretreatment according to process step E | | | | | | | |
|---|---|---|---|---|---|---|---|
| | E1 | E2 | E3 | E4 | E5 | E6 | E7 |
| $Zr^1/mgkg^{-1}$ | 150 | 150 | 150 | 150 | 150 | 150 | 150 |
| Adhesion promoter[2] | — | C1 | C2 | C3 | C4 | C5 | C1 |
| $Cu^3/mgkg^{-1}$ | 20 | 20 | 20 | 20 | 20 | 20 | 25 |
| $Zn^4/mgkg^{-1}$ | 600 | 600 | 600 | 600 | 600 | 600 | 600 |
| $NO_3/mgkg^{-1}$ | 6000 | 6000 | 6000 | 6000 | 6000 | 6000 | 6000 |
| Fluoride[5]/$mgkg^{-1}$ | 25 | 25 | 25 | 25 | 25 | 25 | 25 |
| pH | 4.2 | 4.2 | 4.2 | 4.2 | 4.2 | 4.2 | 4.5 |
| Duration/seconds | 180 | 180 | 180 | 180 | 180 | 180 | 600 |
| Zr thickness[6]/$mgm^{-2}$ | 119 | 70 | 88 | 100 | 86 | 72 | 178 |
| Cu thickness[7]/$mgm^{-2}$ | 48 | 16 | 20 | 36 | 20 | 8 | 57 |

[1]source: $H_2ZrF_6$
[2]in each case 100 $mgkg^{-1}$
[3]source: $Cu(NO_3)_2$
[4]source: $Zn(NO_3)_2$
[5]as free fluoride directly in application solution determined by means of ion-selective electrode with calibrated potentiometric combination electrode (WTW, inoLab ®, pH/IonLevel 3)
[6,7]determined by means of an X-ray fluorescence analyzer (Thermo Fisher Scientific, Niton ® XL3t 900)

Anti-Corrosion Results:

First of all, at least equivalent corrosion results were always able to be achieved on all substrates in comparison with the base formulation E1. The improvement of the corrosion values manifests itself clearly in the presence of adhesion promoters C1-C5 on the substrate CRS, in particular for adhesion promoters in which the molar ratio of acrylate to amine is above 0.5 and below 1.5 (E2, E3 and E5). For these examples according to the invention, a significant improvement in the corrosive disbonding on steel was observed. Another significant aspect is that of ensuring good adhesion values even after a comparatively long 10-minute pretreatment on steel (E3 vs. E7).

TABLE 3

| Anti-corrosion results after paint coat build-up Corrosive delamination* at the intersection after storage in the alternating climate test VW according to PV1210: | | | | | | | |
|---|---|---|---|---|---|---|---|
| | E1 | E2 | E3 | E4 | E5 | E6 | E7 |
| on CRS | | | | | | | |
| Corrosion/mm | 1.2 | 0.9 | 0.8 | 1.6 | 0.7 | 1.4 | 1.1 |
| Delamination/mm | 3.5 | 0.9 | 0.8 | 2.6 | 0.7 | 1.4 | 1.3 |
| Stone impact | 5.0 | 2.5 | 2.5 | 5.0 | 2.5 | 5.0 | 3.7 |
| on HDG | | | | | | | |
| Corrosion/mm | 2.8 | 3.0 | 2.8 | 2.6 | 3.3 | 3.1 | 5.4 |
| Delamination/mm | 2.8 | 3.0 | 2.8 | 2.6 | 3.3 | 3.1 | 5.4 |
| Stone impact | 5.0 | 5.0 | 5.0 | 4.8 | 5.0 | 5.0 | 4.5 |
| Filiform test# after storage according to DIN EN 3665: | | | | | | | |
| Maximum thread length | 1.0 | 1.5 | 0.6 | 1.0 | 0.9 | 0.9 | 1.2 |
| Average thread length | 0.1 | 0.1 | 0.1 | 0.1 | 0.1 | 0.1 | 0.1 |

*corrosion and delamination according to DIN EN ISO 4628-8; stone impact test according to DIN EN ISO 20567-1
#thread lengths in mm according to Daimler PAPP PWT 3002

The invention claimed is:

1. An acidic aqueous composition for the anti-corrosion pretreatment of metal surfaces, containing (A) at least one water-soluble compound of the elements Zr, Ti and/or Si;

(B) at least one source of fluoride ions; and (C) at least one adhesion promoter comprising an organic compound having at least one tertiary amine group that is linked via a bridge-forming divalent functional group to the carbonyl carbon atom of an amide group, wherein the bridge-forming divalent functional group has two carbon atoms as bridge atoms, wherein at least 0.005 g/kg, but no more than 5 g/kg of organic compounds that are adhesion promoters according to component (C) are contained as component (C);

wherein the adhesion promoter according to component (C) additionally comprises at least one secondary amine group which is linked via at least one bridge-forming divalent functional group to a carbonyl carbon atom of an amide group, the bridge-forming divalent functional group having two carbon atoms as bridge atoms.

2. The composition according to claim 1, wherein the adhesion promoter according to component (C) additionally comprises at least one primary amine group.

3. The composition according to claim 1, wherein the molar ratio of total number of primary and secondary amine groups to number of tertiary amine groups with respect to total of the adhesion promoters according to component (C) is less than 5, but more than 0.75.

4. The composition according to claim 1, wherein the two carbon atoms of the bridge-forming functional group are in turn substituted, independently of one another, with functional groups selected from hydrogen, branched or unbranched aliphatic compounds having no more than 6 carbon atoms, alkylcarboxylic acids having no more than 5 carbon atoms, or with divalent aliphatic functional groups having at least 3, but no more than 5, carbon atoms that interlink the two bridge atoms.

5. The composition according to claim 1, wherein the molecular weight of the adhesion promoter according to component (C) is greater than 200 g/mol.

6. The composition according to claim 1, wherein the total quantity of all of the adhesion promoters according to component (C) contained in the composition has a weight-average molar mass greater than 500 g/mol.

7. The composition according to claim 1, wherein the adhesion promoter is a reaction product of a quantity of one or more di- and/or polyamines with a quantity of an α, β-unsaturated carboxylic acid, ester or amide thereof, reacted in a one-pot reaction wherein the quantity of di- and/or polyamines is provided first and the quantity of the α, β-unsaturated carboxylic acid, ester or amide thereof is added gradually.

8. The composition according to claim 7, wherein the molar ratio of the di- and/or polyamines to the α, β-unsaturated carboxylic acid, ester, or amide thereof, is no more than 2, but no less than 0.5.

9. The composition according to claim 7, wherein the one or more di- and/or polyamines are selected from one or more alkylene diamines having no more than 12 carbon atoms and one or more polyalkylene amines having no more than 12 carbon atoms between neighboring amine groups and combinations thereof; and the α, β-unsaturated carboxylic acid, ester, or amide thereof, are selected from (meth)acrylic acid methyl ester and (meth)acrylic acid ethyl ester and combinations thereof.

10. The composition according to claim 1, wherein a total of at least 0.005 g/kg, but no more than 1 g/kg of water-soluble compounds of the elements Zr, Ti and/or Si calculated as Zr are contained as component (A).

11. The composition according to claim 1, wherein a weight ratio of component (A) calculated as Zr to component (C) is no less than 0.2, but no more than 10.

12. A method for an anti-corrosion coating of components made at least in part of metal materials, comprising steps of i) contacting at least some surfaces of a component with an aqueous composition according to claim 1, the at least some surfaces being made of metal materials; and then ii) painting at least some of the surfaces contacted with the aqueous composition in step i).

13. A painted metal substrate comprising a mixed organic/inorganic intermediate layer consisting of oxides, hydroxides and/or oxyfluorides of the elements Zr, Ti and/or Si and organic compounds having at least one tertiary amine group that is linked via a bridge-forming divalent functional group to the carbonyl carbon atom of an amide group, wherein the bridge-forming divalent functional group has two carbon atoms as bridge atoms and at least one secondary amine group which is linked via at least one bridge-forming divalent functional group to a carbonyl carbon atom of an amide group, the bridge-forming divalent functional group having two carbon atoms as bridge atoms.

14. A method of improving paint adhesion to metal surfaces comprising pretreating the metal surfaces before painting with a pretreatment comprising an adhesion promoter selected from organic compounds having at least one tertiary amine group that is linked via a bridge-forming divalent functional group to the carbonyl carbon atom of an amide group, the bridge-forming divalent functional group having two carbon atoms as bridge atoms, and at least one secondary amine group which is linked via at least one bridge-forming divalent functional group to a carbonyl carbon atom of an amide group, the bridge-forming divalent functional group having two carbon atoms as bridge atoms; wherein the adhesion promoter is present in an amount of at least 0.005 g/kg, but no more than 5 g/kg; wherein the organic compounds have a weight-average molar mass that is greater than 500 g/mol.

15. An acidic aqueous composition for the anti-corrosion pretreatment of metal surfaces, containing (A) at least one water-soluble compound of the elements Zr, Ti and/or Si;

(B) at least one source of fluoride ions; and (C) at least one adhesion promoter comprising an organic compound having at least one tertiary amine group that is linked via a bridge-forming divalent functional group to the carbonyl carbon atom of an amide group, wherein the bridge-forming divalent functional group has two carbon atoms as bridge atoms, wherein at least 0.005 g/kg, but no more than 5 g/kg of organic compounds that are adhesion promoters according to component (C) are contained as component (C);

the composition further comprising at least a source of copper ions.

16. The composition according to claim 15, wherein the source of copper ions is a water-soluble salt.

17. The composition according to claim 15, further comprising at least 0.1 g/kg of zinc ions.

18. The composition according to claim 17, further comprising an inorganic nitrogen compound.

19. The composition according to claim 18, wherein the inorganic nitrogen compound is a water-soluble nitrate salt.

20. A method of improving paint adhesion to metal surfaces comprising pretreating the metal surfaces before painting with a pretreatment according to claim 15.

21. A painted metal substrate made according to the method of claim 20.

* * * * *